US007107738B2

(12) United States Patent
Ausnit et al.

(10) Patent No.: US 7,107,738 B2
(45) Date of Patent: Sep. 19, 2006

(54) TAMPER-EVIDENT RECLOSABLE BAG HAVING SLIDER-ACTUATED STRING ZIPPER

(75) Inventors: Steven Ausnit, New York, NY (US); Basil C. Linton, Loganville, GA (US); Gregory H. Crunkleton, Nicolson, GA (US)

(73) Assignee: Illinois Tool Works Inc., Glenview, IL (US)

( * ) Notice: Subject to any disclaimer, the term of this patent is extended or adjusted under 35 U.S.C. 154(b) by 406 days.

(21) Appl. No.: 10/617,234

(22) Filed: Jul. 10, 2003

(65) Prior Publication Data

US 2004/0161167 A1 Aug. 19, 2004

Related U.S. Application Data

(63) Continuation-in-part of application No. 10/367,450, filed on Feb. 14, 2003, now Pat. No. 6,951,421.

(51) Int. Cl.
*B65B 61/18* (2006.01)
*B31B 1/90* (2006.01)

(52) U.S. Cl. ..... 53/412; 53/133.4; 53/139.2; 493/213; 493/927

(58) Field of Classification Search ..... 53/412, 53/133.4, 139.2; 493/212, 213, 214, 927; 383/63, 64, 65
See application file for complete search history.

(56) References Cited

U.S. PATENT DOCUMENTS

| | | | | |
|---|---|---|---|---|
| 4,191,230 | A | 3/1980 | Ausnit | 150/3 |
| 4,601,694 | A * | 7/1986 | Ausnit | 493/213 |
| 4,807,300 | A * | 2/1989 | Ausnit et al. | 383/65 |
| 4,812,074 | A * | 3/1989 | Ausnit et al. | 493/213 |
| 4,892,414 | A * | 1/1990 | Ausnit | 493/214 |
| 5,023,122 | A | 6/1991 | Boeckmann et al. | 428/43 |
| 5,127,208 | A * | 7/1992 | Custer et al. | 53/412 |
| 5,334,127 | A * | 8/1994 | Bruno et al. | 493/214 |
| 5,400,568 | A * | 3/1995 | Kanemitsu et al. | 53/412 |
| 5,558,613 | A * | 9/1996 | Tilman et al. | 493/213 |
| 5,561,966 | A * | 10/1996 | English | 53/412 |
| 5,927,855 | A * | 7/1999 | Tomic et al. | 493/214 |
| 5,983,466 | A * | 11/1999 | Petkovsek | 383/63 |
| 6,138,329 | A * | 10/2000 | Johnson | 383/63 |
| 6,220,754 | B1 | 4/2001 | Stiglic et al. | |
| 6,257,763 | B1 | 7/2001 | Stolmeier et al. | |
| 6,347,885 | B1 | 2/2002 | Buchman | 383/5 |
| 6,354,738 | B1 | 3/2002 | Buckman et al. | 383/5 |
| 6,409,384 | B1 | 6/2002 | Provan et al. | 383/5 |
| 6,477,821 | B1 | 11/2002 | Bois | 53/412 |
| 6,526,726 | B1 * | 3/2003 | Strand et al. | 53/412 |
| 6,581,358 | B1 * | 6/2003 | Buchman | 53/412 |
| 6,595,689 | B1 * | 7/2003 | Borchardt et al. | 383/64 |
| 6,609,827 | B1 * | 8/2003 | Bois et al. | 383/64 |
| 6,863,645 | B1 * | 3/2005 | Crunkleton et al. | 493/213 |

(Continued)

*Primary Examiner*—Louis Huynh
(74) *Attorney, Agent, or Firm*—Ostrager Chong Flaherty & Broitman P.C.

(57) ABSTRACT

Reclosable bags having a slider-actuated string zipper and a tamper-evident feature. In one aspect, the reclosable bag comprises: a receptacle having a mouth and an interior volume; a string zipper installed in the mouth; a slider mounted to the string zipper; and a tamper-evident feature that blocks access to all or a portion of the interior volume. The tamper-evident feature may take the form of an internal membrane that partitions the interior volume or an external header that covers the string zipper. In some embodiments with a partitioned interior volume, the tamper-evident feature comprises a peel seal.

6 Claims, 8 Drawing Sheets

U.S. PATENT DOCUMENTS 6,884,208 B1 * 4/2005 Haws ..... 493/214
6,925,688 B1 * 8/2005 Savicki ..... 493/213
6,942,608 B1 * 9/2005 Linton et al. ..... 493/213
6,951,421 B1 * 10/2005 Crunkleton et al. ..... 383/64
2002/0034339 A1 3/2002 Bois

* cited by examiner

TAMPER-EVIDENT RECLOSABLE BAG HAVING SLIDER-ACTUATED STRING ZIPPER

RELATED PATENT APPLICATION

This application is a continuation-in-part of and claims priority from U.S. patent application Ser. No. 10/367,450 filed on Feb. 14, 2003, now U.S. Pat. No. 6,951,421.

BACKGROUND OF THE INVENTION

This invention generally relates to reclosable bags having slider-actuated plastic zippers. In particular, the invention relates to reclosable bags having slider-actuated string zippers.

In the use of plastic bags, pouches and other packages, particularly for containing foodstuffs, it is important that the bag be hermetically sealed and tamper evident until the purchaser acquires the bag and its contents, takes them home, and opens the bag or package for the first time. It is then commercially attractive and useful for the consumer that the bag or package be reclosable so that its contents may be protected. Such bags provide the consumer with the ability to readily store, in a closed, if not sealed, package any unused portion of the packaged product even after the package is initially opened. Flexible plastic zippers have proven to be excellent for reclosable bags, because they may be manufactured with high-speed equipment and are reliable for repeated reuse.

Many reclosable bags comprise a receptacle having a mouth with a slider-actuated zipper installed therein for opening and closing the bag. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper parts can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

Various additions to reclosable bags have been made to provide tamper-evident seals or indicators that will reveal when the bag has been opened or otherwise tampered with prior to purchase by the consumer. It is known to provide a reclosable package construction that is designed to undergo some permanent change in the package appearance when the package is opened for the first time. For example, it is known to provide a reclosable package with a tamper-evident, non-reclosable peel seal that gives a positive indication of having been broken when a package is first opened. It is also known to shroud the zipper (with or without slider) inside an enclosed header on the top of the bag. Another type of tamper-evident feature is the provision of a membrane on the product side of the zipper that partitions the interior volume in an airtight manner.

There is a continuing need for new designs for reclosable bags with tamper-evident features for hermetic and non-hermetic packages that can be manufactured at low cost.

BRIEF DESCRIPTION OF THE INVENTION

The present invention is directed to reclosable bags that have a slider-actuated string zipper and a tamper-evident feature. The invention is further directed to methods of manufacturing such bags.

One aspect of the invention is a reclosable bag comprising: a receptacle having a mouth and an interior volume; a string zipper installed in the mouth; a slider mounted to the string zipper; and a tamper-evident feature that blocks access to all or a portion of the interior volume.

Another aspect of the invention is a reclosable bag comprising: a zipper comprising first and second flangeless zipper strips, the first zipper strip comprising a first base and a first closure profile projecting from the first base, and the second zipper strip comprising a second base and a second closure profile projecting from the second base and engaged with the first closure profile; a film structure comprising: a first attachment portion joined to the first base of the first zipper strip; a second attachment portion joined to the second base of the second zipper strip, the zipper being disposed between the first and second attachment portions of the film structure; a receptacle portion integrally connected to the first and second attachment portions and having an interior volume; and a tamper-evident feature portion having one side integrally connected to the first attachment portion, the tamper-evident feature portion blocking access to all or a portion of the interior volume; and a slider mounted to the zipper and comprising first and second side walls having interior surfaces confronting opposing portions of the first and second attachment portions respectively.

A further aspect of the invention is a reclosable bag comprising: first and second flangeless zipper strips having mutually interlockable closure profiles that are joined at opposite ends of the first and second zipper strips; a peel seal; a first layer of film material comprising a first portion joined to a back of the first flangeless zipper strip, a second portion joined to one side of the peel seal, and a third portion connecting the first and second portions of the first layer; a second layer of film material comprising a first portion joined to a back of the second flangeless zipper strip, a second portion joined to another side of the peel seal, and a third portion connecting the first and second portions of the second layer; a third layer of film material comprising a portion merged with the first portion of the first layer; a fourth layer of film material comprising a portion merged with the first portion of the second layer, portions of the third and fourth layers being joined to form a receptacle; and a slider mounted to the first and second flangeless zipper strips. The first portion of the first layer and the merged portion of the third layer are disposed between the back of the first flangeless zipper strip and a confronting first portion of the slider, and the first portion of the second layer and the merged portion of the fourth layer are disposed between the back of the second flangeless zipper strip and a confronting second portion of the slider.

Yet another aspect of the invention is a reclosable bag comprising: first and second flangeless zipper strips having mutually interlockable closure profiles that are joined at opposite ends of the first and second zipper strips; a peel seal; a first layer of film material comprising a first portion joined to a back of the first flangeless zipper strip, a second portion joined to one side of the peel seal, and a third portion connecting the first and second portions; a receptacle comprising second and third layers of film material joined together along a portion of a periphery, the second layer of film material comprising a portion merged with the first portion of the first layer, and the third layer of film material comprising a first portion joined to a back of the second flangeless zipper strip, a second portion joined to another side of the peel seal, and a third portion connecting the first and second portions of the third layer; and a slider mounted to the first and second flangeless zipper strips. The first portion of the first layer and the merged portion of the second layer are disposed between the back of the first flangeless zipper strip and a confronting first portion of the slider, and the first portion of the third layer is disposed between the back of the second flangeless zipper strip and a confronting second portion of the slider.

A further aspect of the invention is a method of manufacture comprising the following steps: (a) folding a first portion of a monolithic film structure to form a generally M-shaped gusseted end comprising first through fourth layers of film material; (b) inserting a string zipper between the second and third layers of the gusseted end; (c) sealing the first and second layers of the gusseted end to each other and to one side of the string zipper; (d) sealing the third and fourth layers of the gusseted end to each other and to another side of the string zipper; and (e) inserting a slider on the string zipper after steps (c) and (d).

Yet another aspect of the invention is a method of manufacturing a reclosable bag, comprising the following steps: (a) arranging and sealing film material to form a receptacle having a mouth and an interior volume with a tamper-evident feature that blocks access to the interior volume; (b) prior to completion of the receptacle with tamper-evident feature, joining opposing portions of the film material, that will form the mouth of the receptacle, to respective backs of first and second flangeless zipper strips; (c) aligning the first and second flangeless zipper strips with each other; and (d) after steps (b) and (c), mounting a slider onto the aligned first and second flangeless zipper strips with respective portions of the opposing portions of the film material being disposed between respective side walls of the slider and respective backs of the first and second flangeless zipper strips.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
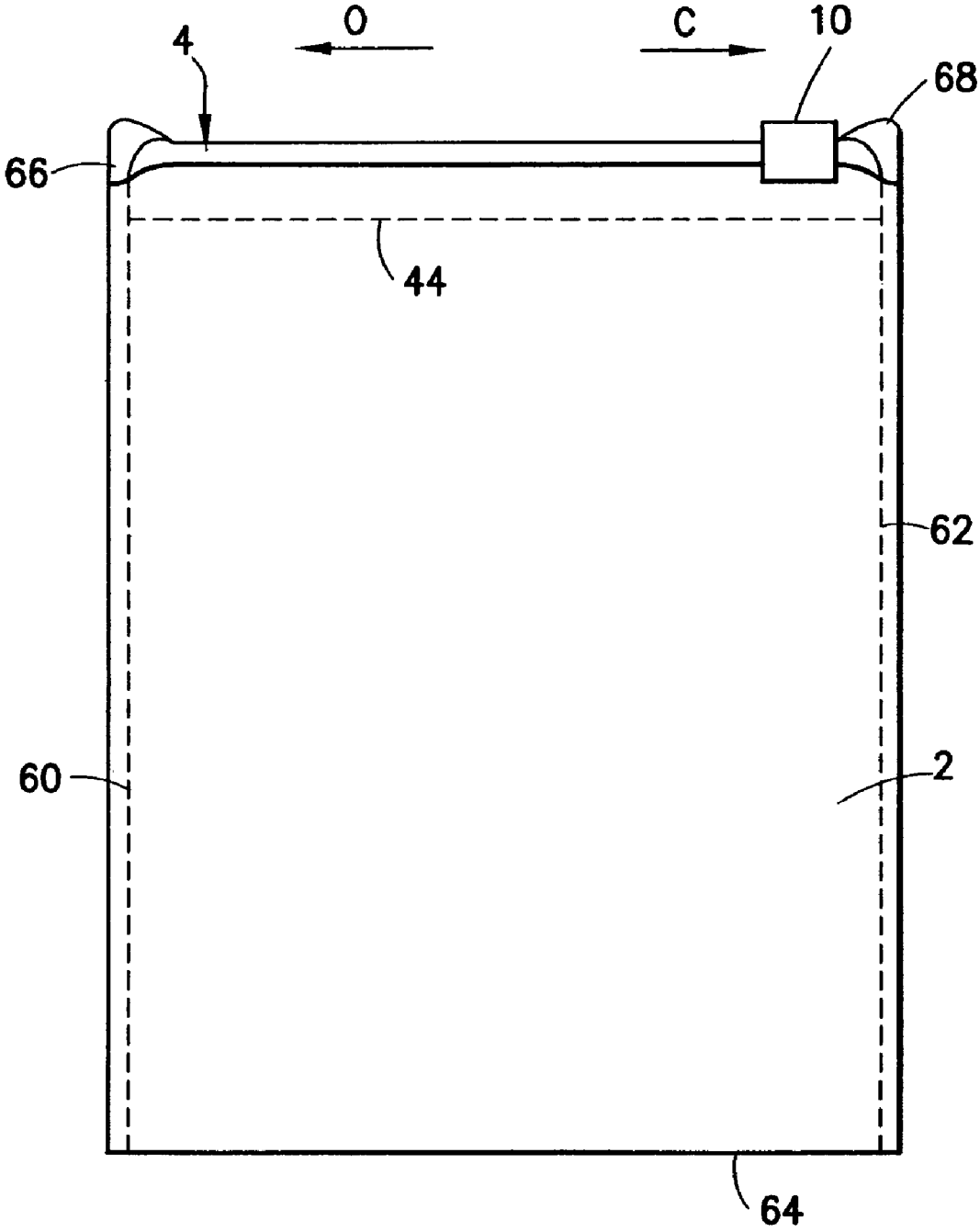
FIG. 1 is a drawing showing a front view of a reclosable bag in accordance with one embodiment of the present invention. For the purpose of this illustration, it has been assumed that the bag film is optically transparent, so that the string zipper and the tamper-evident seal (demarcated by a dashed line) are visible behind a layer of film.

A reclosable package or bag comprising a receptacle 2 and a flexible plastic string zipper 4 operated by manipulation of a slider 10 is shown in FIG. 1. It should be understood that the slider-zipper assemblies disclosed herein can be installed in a reclosable package or bag of the type shown in FIG. 1 or other types of reclosable packages having different structures.

The receptacle 2 may be made from any suitable film material, including thermoplastic film materials such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. The receptacle 2 comprises opposing walls (only the front panel is visible in FIG. 1) that may be secured together at opposite side edges of the bag by seams 60 and 62 (indicated by dashed lines). The opposing bottoms of the walls may be joined, for example, by means of a heat seal 64 (indicated by a dashed line) made in conventional fashion, e.g., by application of heat and pressure.

Figure 2:
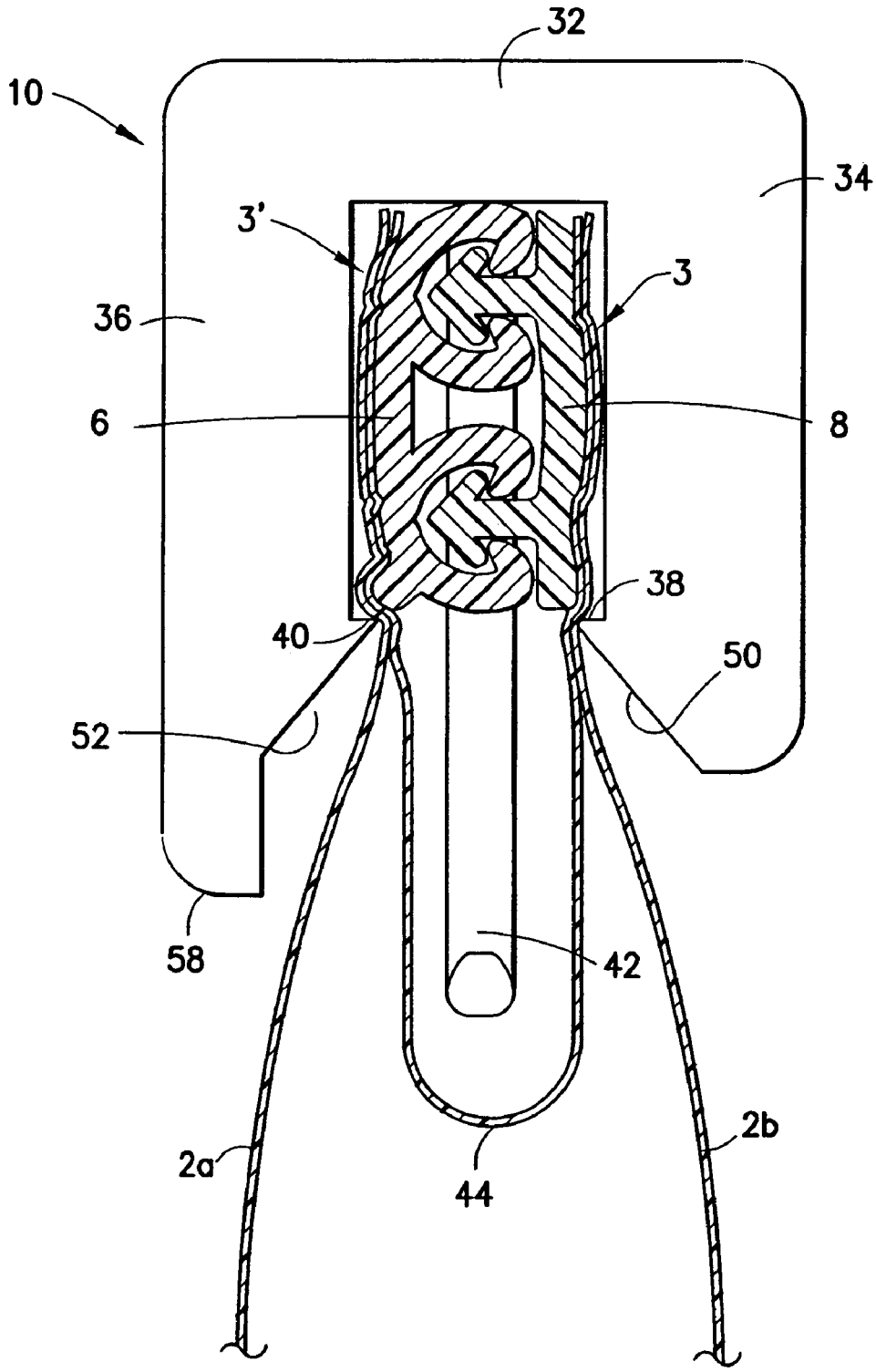
FIG. 2 is a drawing showing a fragmentary sectional view of a slider-string zipper assembly incorporated in the bag depicted in FIG. 1. The zipper and bag film are shown sectioned in a plane in front of the closing end of the slider.

At its top end, the receptacle 2 has an openable mouth, on the inside of which is an extruded plastic string zipper 4. The string zipper 4 comprises a pair of interlockable zipper strips 6 and 8 (best seen in FIG. 2). Although FIG. 2 shows a rib and groove arrangement, the profiles of the zipper halves may take any form. For example, the string zipper may comprise interlocking rib and groove elements (as shown in FIG. 2) or alternating hook-shaped closure elements. The preferred zipper material is polyethylene or polypropylene. The string zipper 4 is operated by sliding the slider 10 along the zipper strips. As the slider moves across the zipper, the zipper is opened or closed. As shown in FIG. 1, the slider is slidable along the zipper in a closing direction "C", causing the zipper strips to become engaged, or in an opening direction "O", causing the zipper strips to become disengaged.

Referring again to FIG. 1, the string zipper 4 further comprises end stops 66 and 68 for preventing the slider 10 from sliding off the end of the zipper when the slider reaches the zipper closed or fully opened position. Typically, the end stops are formed by fusing the ends of the zipper strips together while at the same time shaping the fused material into an end stop structure. Such end stops perform dual functions, serving as stops to prevent the slider from going off the end of the zipper and also holding the two zipper profiles together to prevent the bag from opening in response to stresses applied to the profiles through normal use of the bag. However, the present invention is not limited to the incorporation of a slider end stop structure of any particular type.

In accordance with various embodiments of the present invention, a tamper-evident seal (or feature) is formed in the interior of the bag on the product side of the string zipper. In one embodiment, the tamper-evident seal takes the form of a U-shaped or V-shaped membrane of bag making film that is suspended from the zipper on the product side thereof. In FIG. 1, the dashed line 44 demarcates the cusp of such a U- or V-shaped membrane. One side of the membrane is joined to the back of one zipper strip, while the other side of the membrane is joined to the back of the other zipper strip. The ends of the membrane 44 are captured in the side seals 60 and 62, thereby hermetically sealing the interior volume of the bag. [Alternatively, in cases where a hermetic seal is not required, the membrane does not need to be joined at its ends to the side seals of the bag.] To have access to the contents of the bag, the user must first open the zipper by moving the slider and then tear open the membrane 44 disposed inside the bag.

The structure of the bag in accordance with some embodiments of the invention is shown in detail in FIG. 2. The membrane 44 comprises a first layer of film material that has been folded into a U- or V-shape and that has respective marginal portions joined (e.g., by conduction heat sealing) to the backs of a pair of interlocked flangeless zipper strips 6 and 8. A second layer of the same film material, having a marginal portion merged with one marginal portion of the first layer, forms a front wall 2*a* of the receptacle 2, while a third layer of the same film material, having a marginal portion merged with the other marginal portion of the first layer, forms a rear wall 2*b* of the receptacle 2. [The merged portions of the first, second and third layers of film material are depicted as being distinct layers in FIGS. 2 and 3 for the purpose of illustration only. In reality, the interface between the melted layers of film would be less distinct, if not indistinguishable.] The front and rear walls 2*a* and 2*b* are typically sealed together along three sides (as illustrated in FIG. 1) to form the receptacle. At the same time, the marginal portions on the sides of the folded first layer of film material may be captured in the side seals of the receptacle. As a result, the membrane 44 will form a tamper-evident hermetic seal.

Still referring to FIG. 2, the string zipper comprises a pair of interlockable zipper parts or strips 6 and 8. Although FIG. 2 shows a rib and groove arrangement, the profiles of the zipper strips may take any form. For example, the string zipper may comprise interlocking rib and groove elements (as shown in FIG. 2) or alternating hook-shaped closure elements. The preferred zipper material is polyethylene or polypropylene. The merged marginal portions of the membrane 44 and the receptacle walls 2*a* and 2*b* may be respectively sealed to the backs of the zipper strips 6 and 8 by a conventional conduction heat sealing technique.

After the film material has been joined to the string zipper and any excess film beyond the zipper has been trimmed, a slider is inserted on the string zipper. In the example depicted in FIG. 2, the slider has a separating finger or plow 42 that projects into an opening between opposing sections of the zipper strips. To open more zipper, the zipper strips 6 and 8 are pushed apart with sufficient force by the slider plow 42 to pry the heads of the male members out of the female profiles. When the shoulders of the male members clear the hooks of the outwardly flexed gripper jaws, the male and female members are no longer interlocked and the zipper is open.

Figure 3:
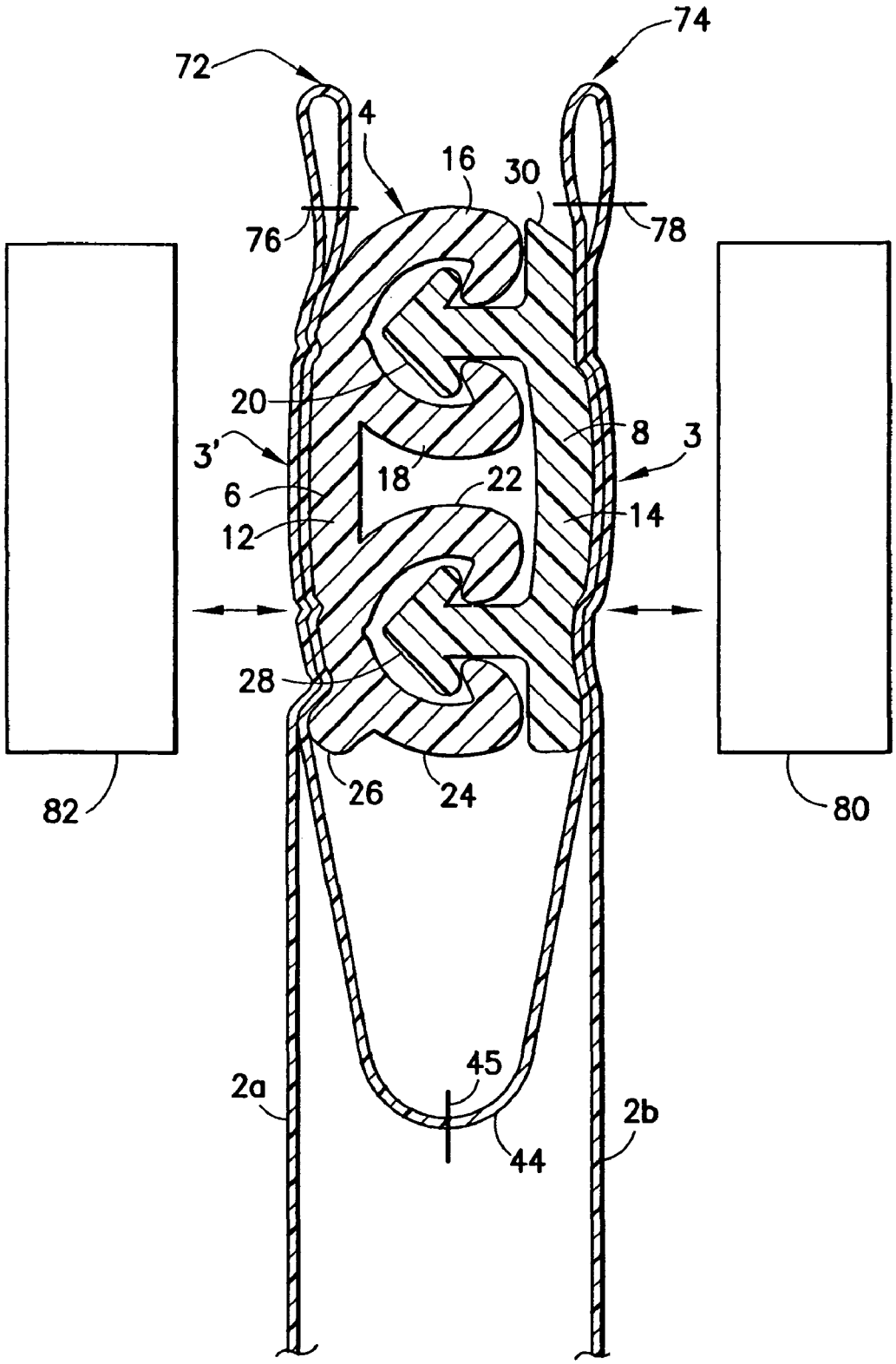
FIG. 3 is a drawing showing a fragmentary sectional view of a string zipper joined to a folded web at an intermediate stage in a manufacturing process in accordance with one embodiment of the invention.

FIG. 3 shows a stage in the manufacture of the bag partially depicted in FIG. 2. In accordance with this method of manufacture, one starts with a single web of film material that is folded three times to form an M-shaped gusseted end. The string zipper is inserted into the gusset (at a distance from the cusp of the gusset) and then the film is heat sealed to the string zipper on both sides to form merged double layers 3 and 3'. A pair of hot sealing bars 80 and 82 is generally represented by rectangles spaced on opposing sides of the zipper. The sealing bars reciprocate between retracted positions (seen in FIG. 3) and extended positions (not shown). Heat sealing occurs when the extended sealing bars 80 and 82 press the double layers of film material against the respective backs of flangeless zipper strips 6 and 8. The sealing bars form band-shaped zones of joinder. After sealing of the double layers to the zipper, the folded edges 72 and 74 may extend above the zipper on respective sides thereof. These folded loops will later be trimmed by cutting along cut lines 76 and 78. After trimming of the folded edges 72 and 74, the upper margins of the double layers of bag film may have short free ends (below the cut lines 76 and 78 depicted in FIG. 3) that extend above the zones of joinder, provided that these free ends are not so long as to interfere with travel of the slider along the zipper or become entangled with the zipper profiles. Alternatively, the folds 72 and 74 may be sufficiently aligned with the zipper strips 6, 8 that no trimming is necessary.

The zipper in this example is an extruded plastic structure comprising mutually interlockable profiled flangeless zipper strips 6 and 8. Zipper strip 8 comprises a base and two generally arrow-shaped rib-like male closure elements or members 20 and 28 projecting from a base 14, while zipper strip 6 comprises two pairs of hook-shaped gripper jaws connected by a sealing bridge 12. The pairs of gripper jaws form respective complementary female profiles for receiving the male profiles of closure elements 20 and 28. More specifically, jaws 16 and 18 receive and interlock with the male element 20, while jaws 22 and 24 receive and interlock with the male element 28. The sealing bridge 12 and the base 14 are resiliently flexible self-supporting structures having a thickness greater than the thickness of the bag film. The male closure elements are integrally formed with the base 14, while the female closure elements are integrally formed with the sealing bridge 12.

Still referring to FIG. 3, the end face of upper edge 30 of the base 14 that carries the male closure elements 20 and 28 is inclined at about a 45° angle to facilitate loading of the slider onto the zipper from above without snagging on a corner of the upper edge. The bottom edge of the base 14 cooperates with a retaining ledge on the slider to increase the slider pull-off resistance. For the same purpose, a rib 26 is formed on zipper part 6, the rib 26 cooperating with a retaining ledge on the other side of the slider.

Numerous configurations for the interlockable male and female members are known in the art. The present invention is not limited to use with male members having an arrow-shaped head. In addition, although FIGS. 2 and 3 show a rib-and-groove arrangement, the profiles of the zipper strips may take any form. For example, either string zipper may comprise alternating hook-shaped closure elements.

The slider 10 shown in FIG. 2 is fully disclosed in U.S. patent application Ser. No. 10/367,450 and comprises a top wall 32, a pair of side walls 34 and 36 connected to opposing sides of the top wall 32, the top wall 32 and side walls 34, 36 forming a tunnel for passage of the string zipper therethrough. The width of the tunnel is substantially constant along the section that is divided by a plow 42 and then narrows from a point proximal to the end of the plow to the closing window at one end face of the slider. The plow 42 depends downward from a central portion of the top wall 32 to an elevation below the lowermost portions of each side wall, and has rounded edges and flattened corners at the tip to facilitate insertion of the plow between the zipper profiles without snagging during automated slider insertion. As the slider is moved in the opening direction (i.e., with the closing end leading), the plow 42 pries the impinging sections of zipper strips 6 and 8 apart. The narrowing section of the slider tunnel is formed by a pair of substantially planar, inclined interior surfaces (not visible in FIG. 2), which converge toward the closing window of the slider. The inclined surfaces funnel or squeeze the zipper strips toward each other, causing the zipper profiles to interlock, as the slider is moved in the closing direction.

As partly seen in FIG. 2, the slider 10 further comprises a retaining projection or ledge 38 that projects inward from the side wall 34 and a retaining projection or ledge 40 that projects inward from the side wall 36. The ledges 38 and 40 project toward each other, forming respective latches for latching the slider onto the zipper. The ledges 38 and 40 further comprise respective generally planar, inclined bottom surfaces 50 and 52 that serve to guide the respective zipper strips 6 and 8 into the slider tunnel during automated slider insertion.

To reduce the cost of manufacture, the slider may be designed to reduce the amount of material used and to increase the speed with which such sliders can be injection molded. Suitable injection-molded slider designs are fully disclosed in U.S. patent application Ser. No. 10/412,438 entitled "Molded Sliders for Actuating Zippers in Reclosable Bags".

The reclosable bags with tamper-evident features and slider-actuated string zippers disclosed herein do not require that the slider have a separating finger. Sliders without separating fingers can also be employed, provided that the zipper strips are suitably designed to be actuated by such sliders.

Reclosable packages of the type partially depicted in FIG. 2 can be manufactured on an automatic production line. In this particular case, the steps of the method of manufacture carried out by such equipment comprise the following steps: First, a web of bag making film is folded along three fold lines to form a generally M-shaped gusseted end comprising first through fourth layers of film material. A string zipper is then inserted at an angle into the space between the two central (i.e., second and third) layers of the gusset. At a zipper sealing station, a section of zipper is sealed to both sides of the gusset, i.e., the first and second layers of the gusset are sealed to each other and to the back of one flangeless zipper strip; while the third and fourth layers of the gusset are sealed to each other and to the back of the other flangeless zipper strip. At the same time, the opposing marginal edges of the folded web of bag making film can be band-sealed together. This seal will become the bottom of the bag. After zipper sealing, the folded edges above the zones of joinder are trimmed, e.g., by stationary knives as the web with zipper is moving. After trimming, a slider is inserted onto the string zipper by a slider insertion device and the zipper is ultrasonically stomped to form slider end stops. A suitable apparatus for inserting sliders onto string zipper material with attached bag making film is fully disclosed in U.S. patent application Ser. No. 10/436,433 entitled "Method and Apparatus for Inserting Sliders During Automated Manufacture of Reclosable Bags". The web is then cut by a hot knife in a transverse direction, the cutting line bisecting the ultrasonically stomped region. The hot knife simultaneously severs the film and zipper and seals the film along the cut edges. Alternatively, product can be placed between the two sides of the folded web before the opposing marginal edges of the web are band-sealed together. In accordance with a further aspect of the invention, a line of weakened tear resistance (e.g., a line of spaced perforations) can be formed in the web prior to folding, the tear line being located such that it is at or near the cusp of the gusset after folding.

Figure 4:
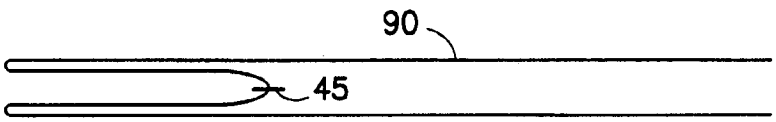
FIGS. 4 through 8 are drawings showing successive steps of a method of making a tamper-evident slider-actuated string zipper package in accordance with another embodiment of the invention.

An alternative method for manufacturing a reclosable bag having a slider-actuated string zipper and a tamper-evident seal on the product side of the zipper is depicted in FIGS. 4–8. First, a web 90 of bag making film is folded along three fold lines to form a generally M-shaped gusseted end comprising first through fourth layers of film material, as shown in FIG. 4. The other end of the web is left open. Optionally, a line of weakened tear resistance may be formed in the web along a centerline before folding. As a result of the folding operation, this line 45 of weakened tear resistance will be located at the cusp of the gusset. In cases where a hermetic seal is required, the line of weakened tear resistance may take the form of a scoreline. If a hermetic seal is not required, then a line of spaced perforations could be used.

Figure 5:
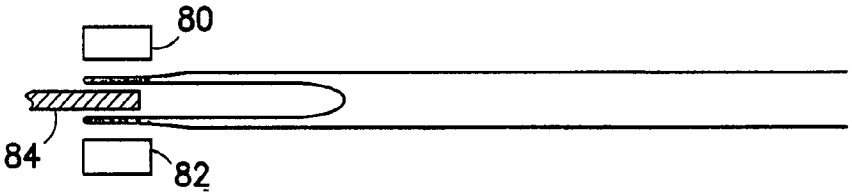

After folding, a separator plate 84 is inserted into the gusset in the area where the string zipper will be joined, as shown in FIG. 5. A pair of heated sealing bars 80 and 82, shown in respective retracted positions in FIG. 5, are then extended until the faces of the sealing bars respectively press the respective layers of folded film against the separator plate 84 from opposite sides thereof. During this operation, the marginal portions of the first and second film layers of the folded web are heat sealed together on one side of the separator plate 84, while the marginal portions of the third and fourth film layers of the folded web are heat sealed together on the other side of the separator plate 84. The separator plate 84 prevents the sealing together of the second and third film layers that form the gusset.

Figure 6:
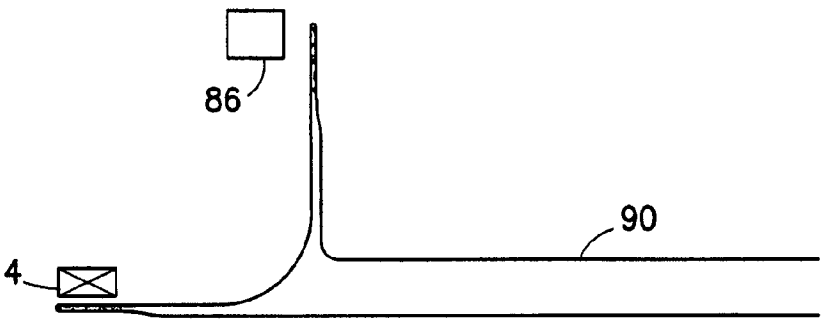
Figure 7:
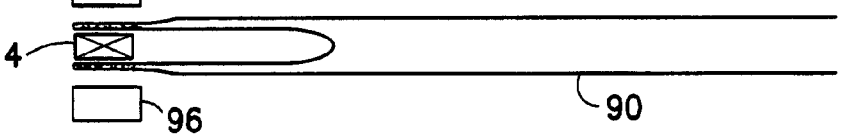
Figure 8:
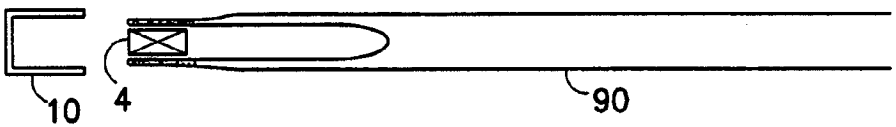

In the next stage of manufacture, one fold is lifted up, or more exactly, pivoted from a generally horizontal position to a generally vertical position, as shown in FIG. 6, by a deflector 86. Then the string zipper 4 is introduced, e.g., by laying string zipper on top of the sealed portion of the fold that was not lifted up, the zipper being disposed proximal and parallel to the edge of the fold. The uplifted fold is then returned to its original position (this step is not shown in the drawings), in which case the zipper 4 will now be sandwiched between the respective sealed portions of the respective fold on opposite sides of the gusset. At a zipper sealing station, another pair of heated sealing bars 94 and 96 (shown in their respective retracted positions in FIG. 7) are then extended into contact with the sealed (i.e., merged) double layers of film on opposite sides of the string zipper 4. During this operation, the merged double layer of film on one side of the gusseted end is joined to the back of one flangeless zipper strip, while the merged double layer of film on the other side of the gusseted end is joined to the back of the other flangeless zipper strip. After the zipper has been attached to the folded web, a slider 10 (see FIG. 8) is inserted over the zipper and respective joined film layers. If due to the difficulty of precisely aligning the string zipper with the edges of the merged double layers of film, portions of the merged film extend beyond the zones of joinder of film to zipper, those portions can be trimmed to prevent interference with the operation of the slider-zipper assembly.

Figure 9:
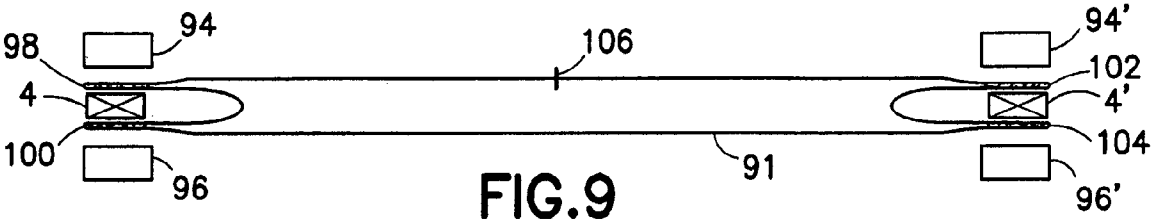
FIGS. 9 through 11 are drawings showing successive steps of a method of dual manufacture of tamper-evident slider-actuated string zipper packages loaded with product.
Figure 10:
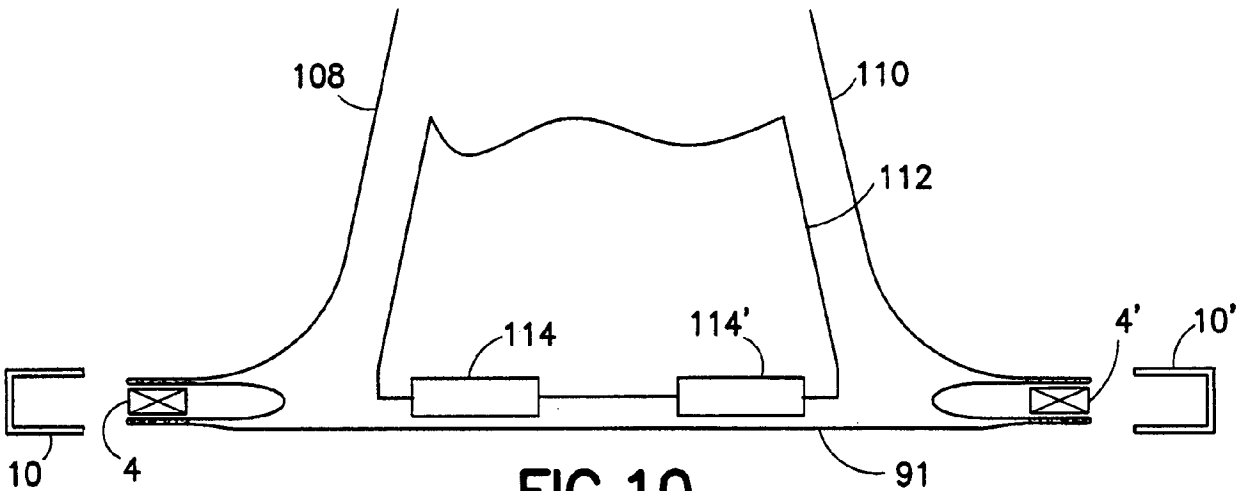
Figure 11:
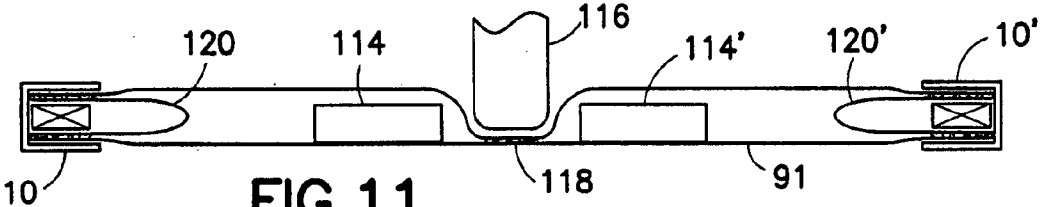

FIGS. 9 through 11 show successive steps of a method of dual manufacture of tamper-evident slider-actuated string zipper packages loaded with product in accordance with a further embodiment of the invention. Starting with a tube of film, the film is folded to form respective M-shaped gusseted ends at diametrally opposite positions, the folding operation at each end being similar to that described previously with reference to FIG. 4. The marginal portions of the outer folds of each gusseted end are then sealed together using separator plates and heated sealing bars in the manner generally described previously with reference to FIG. 5. Then a respective sealed fold at each gusseted end is pivoted to a respective upright position and a respective string zipper is introduced onto the sealed folds that were not uplifted, in the manner previously described with reference to FIG. 6.

The uplifted folds of tubing 91 are then restored to respective horizontal positions overlying the respective string zippers, as shown in FIG. 9. Each string zipper 4 and 4' is then joined to the merged double layers of film that sandwich the zipper. More precisely, the heated sealing bar 94 joins the sealed fold 98 to the back of one flangeless zipper strip of zipper 4; the heated sealing bar 96 joins the sealed fold 100 to the back of the other flangeless zipper strip of zipper 4; the heated sealing bar 94' joins the sealed fold 102 to the back of one flangeless zipper strip of zipper 4'; and the heated sealing bar 96' joins the sealed fold 104 to the back of the other flangeless zipper strip of zipper 4'. In a separate operation, the film tubing 91 is cut along a cutting line 106 that runs generally parallel to and equidistant from the zippers at opposite ends of the tubing. As explained below, this cutting operation allows product to be loaded. Although FIG. 9 depicts concurrent film cutting and zipper sealing operations, a person skilled in the art will recognize that the film could be cut after the zipper have been attached.

After the tubing 91 has been cut, the upper flaps 108, 110 of film on opposite sides of the cut are raised and wrapped around a stationary feeding platform 112 (the zipper-film assembly is moving). The wrapped positions of the film relative to the feeding platform are shown in FIG. 10. Respective masses 114 and 114' of product are loaded onto the bottom layer of film via the feeding platform. Respective sliders 10 and 10' are inserted on the respective string zippers 4 and 4'. Although FIG. 10 depicts concurrent product loading and slider insertion operations, a person skilled in the art will recognize that the sliders could be inserted before or after the product is loaded. The product masses are placed between the zippers and separated from each other by a space where the film will be sealed by a heated sealing bar 116, as shown in FIG. 11. Later the seal 118 will be cut down the middle and the film will be cross cut and sealed to form separate sealed packages, each package being loaded with product and having a tamper-evident seal 120, 120'. It should be understood that instead of tubing, a flat film can be folded in a manner that will provide the same film configuration as that of the tubing, and that the method of attaching a zipper can be as previously described.

Figure 12:
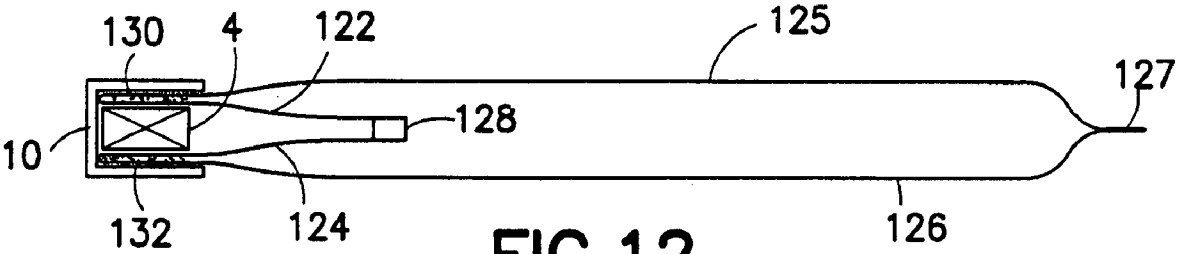
FIG. 12 is a drawing showing a tamper-evident slider-actuated string zipper package in accordance with another embodiment of the invention.

FIG. 12 shows a tamper-evident slider-actuated string zipper package in accordance with another embodiment of the invention. Two webs 125 and 126 of bag making film are folded inward to form two short flaps 122, 124 that are in mutual opposition. The unfolded ends of the webs 125 and 126 are joined by a fin seal 127, which will serve as the bottom of the receptacle. A peel seal 128 is joined to the opposing marginal portions of the flaps 122 and 124, forming a tamper-evident seal. The film layers of the folds 130, 132 are sealed together and these merged double layers of film are in turn joined to the respective backs of the flangeless zipper strips of the string zipper 4. A slider 10 is inserted on the string zipper with the merged layers of the outer folds being respectively disposed between the zipper strips and the side walls of the slider, in the manner depicted in FIG. 2.

Figure 13:
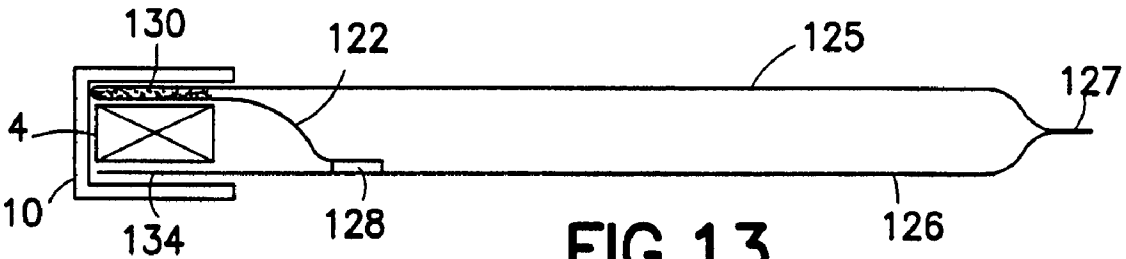
FIG. 13 is a drawing showing an alternative construction of a tamper-evident slider-actuated string zipper package.

FIG. 13 shows an alternative construction of a tamper-evident slider-actuated string zipper package. This construction differs from the construction in FIG. 12 in that only web 125 of bag making film is folded inward to form a solitary inward flap 122. In this case, the peel seal 128 joins the marginal portion of the flap 122 to a band-shaped zone on the opposing wall of the receptacle, thus forming a tamper-evident seal. Also, this embodiment differs from the embodiment of FIG. 12 in that one side of the string zipper 4 is joined to a single layer of film, i.e., the marginal portion 134 of the wall that is joined to the peel seal 128, while the other side of the string zipper is joined to a double layer of merged film material, as previously described. The edges of the film that extend beyond the zone of zipper-film joinder can be trimmed as needed (which is true for all embodiments disclosed herein). Instead of a peel seal, the marginal portion of the flap 122 can be hard sealed to the opposing receptacle wall with a line of weakened tear resistance being provided in the flap.

Alternatively, a single web of film could be folded a first time to form the bottom of the bag and a second time to form the folded double layer that is sealed to one zipper strip. The end result would be a reclosable bag similar in structure to that shown in FIG. 13, but without the fin seal 127 at the bag bottom. The manufacture of this alternative embodiment would involve treating the back edge of the inward flap (on the other side of the peel seal) in a way that would prevent seal through during activation of the peel seal. In this case, the peel seal could activated after the slider has been loaded.

In accordance with a further alternative, a web of film could be folded once to form a U-shape and then a separate strip of film could be sealed to the inside of one wall of the folded web to form the flap 122 seen in FIG. 13. However, the feeding of separate webs or strips of film and then joining them along a margin requires that the respective tensions in the separate webs or strips be separately controlled to be relatively equal.

Figure 14:
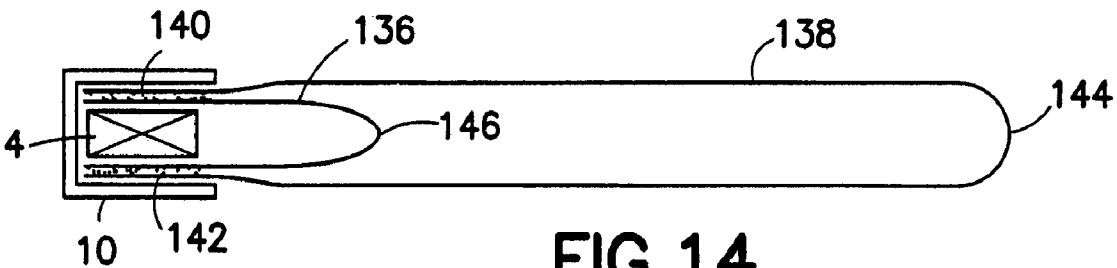
FIG. 14 is a drawing showing a tamper-evident slider-actuated string zipper package in accordance with yet another embodiment of the invention.

Similarly, instead of folding a web of film to form an M-shaped gusseted end, as previously described with reference to FIG. 3, separate webs 136, 138 of film of different width can each be folded into respective U-shapes, as shown in FIG. 14. Then the short folded web 136 is inserted between the sides of the long folded web 138 with their edges respectively aligned. Next, a string zipper 4 is inserted between marginal portions of the short folded web 136. The marginal portions of the long and short folded webs are then heat sealed to the backs of the flangeless strips of the string zipper to form merged double layers 140, 142 of film of the type seen in FIG. 3. The fold 144 in the long folded web forms the bottom of the receptacle, while the fold 146 in the short folded web forms the cusp of a tamper-evident-seal. The web of short width can be perforated or scored along a centerline to form a line of weakened tear resistance at or near the cusp of the tamper-evident seal. The end result is that the final bag will have substantially the same structure as the bag partially depicted in FIG. 2, except that the bottom of the receptacle is formed by a fold 144 instead of a heat seal.

In accordance with a further variation, the same structure depicted in FIG. 14 can be attained starting with a tube of film that is folded to form an M-shaped gusset. Then the double layers of film on opposing sides of the gusset are sealed to opposite sides of a string zipper in the manner previously described. If the gusset edges need to be trimmed, then the final structure would be identical to that shown in FIG. 14. If the outer fold lines are sufficiently aligned with the zipper strips, then the folded edges would not need to be trimmed.

Figure 15:
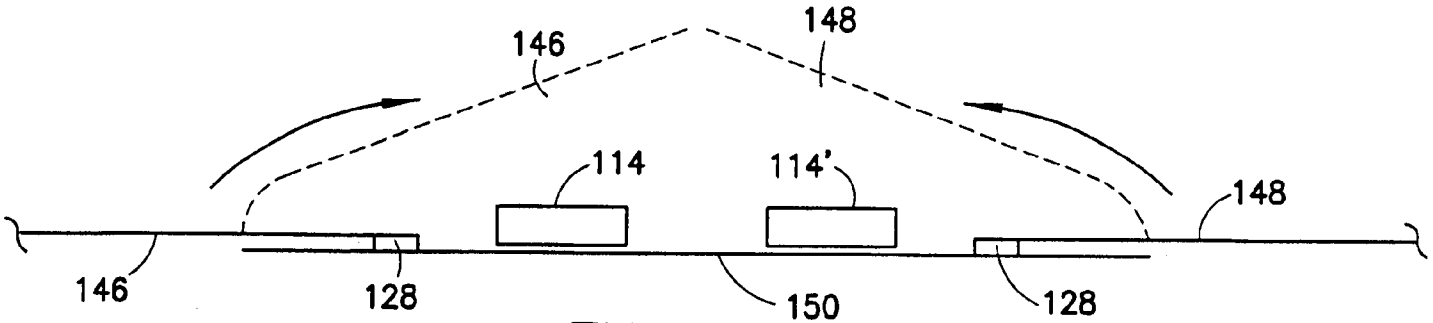
FIGS. 15 and 16 are drawings showing respective stages in the manufacture of the embodiment depicted in FIG. 13.
Figure 16:
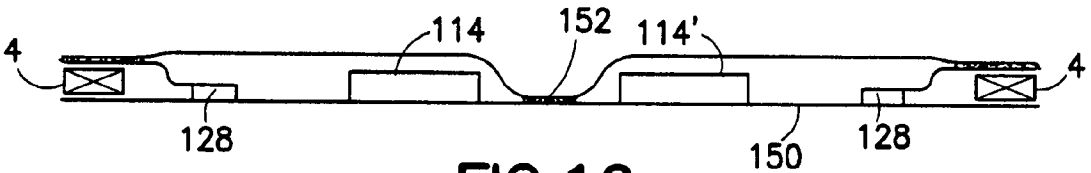

In the case of the embodiment shown in FIG. 13, dual manufacture can be achieved by a method comprising the steps depicted in FIGS. 15 and 16 and other steps not depicted in the drawings. First, respective strips of peel seal material 128 are joined in parallel to respective marginal portions on opposite sides of a film web 150. Then, as depicted in FIG. 15, a marginal portion of a second film web 146 is placed in overlying relationship with and then joined to the peel seal material 128 on one side of web 150, and a marginal portion of a second film web 148 is placed in overlying relationship with and then joined to the peel seal material 128 on the other side of web 150. If the finished bags are to be loaded with product, then before the webs 146 and 148 are folded over (indicated by dashed lines), respective masses of product 114 and 114' are placed on the web 150 at locations between the peel seals 128. The webs 146 and 148 are folded along lines located laterally outward of the respective peel seals.

As shown in FIG. 16, respective string zippers 4 are placed between respective marginal portions of web 150 and opposing respective folded-over portions of webs 146 and 148. The film material on opposing sides of the string zippers 4 is sealed thereto by heated sealing bars (not shown), a respective double layer of film being joined on one side of each string zipper and a respective single layer of film being joined on the other side of each string zipper, as seen in FIG. 16. In another sealing operation, the free ends of the folded-over webs 146 and 148 are joined to a central portion of web 150, the resulting seal 152 being disposed along a centerline of web 150 that runs between the respective masses of product 114 and 114'. After the string zippers have been joined to the film, sliders (not shown) are inserted. When the assembly depicted in FIG. 16 is cross sealed and cut along a transverse line and then cut along the centerline, bisecting the central seal 152, two finished filled packages come off of the production line.

Figure 17:
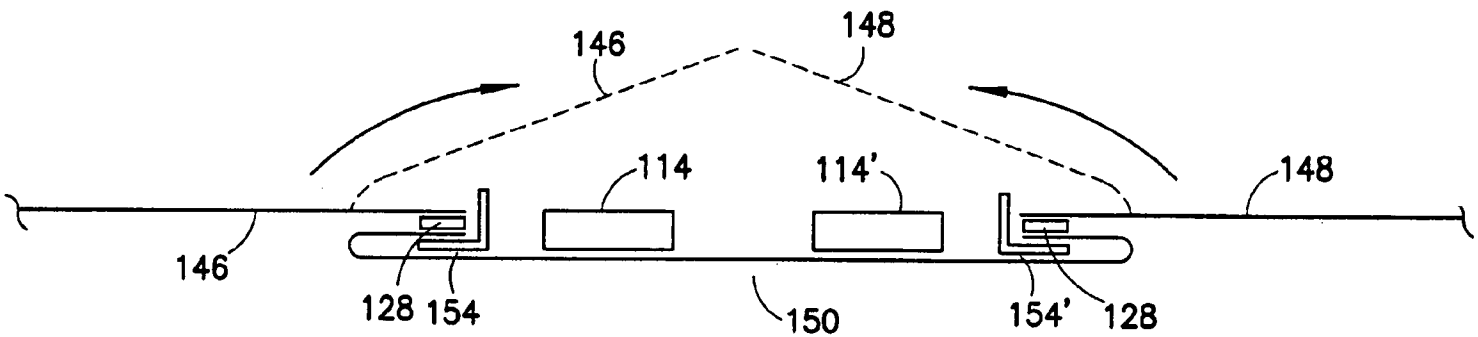
FIG. 17 is a drawing showing a stage in the manufacture of the embodiment depicted in FIG. 12.

The embodiment shown in FIG. 12 is susceptible to dual manufacture in a similar manner, except the web 150 is folded inward on both sides and then the lengths of peel seal material 128 are applied to the inwardly folded flaps, as shown in FIG. 17. To prevent seal-through of the portions of web 150 located below the peel seal material, respective separating plates 154 and 154' are inserted between the overlapping portions of web 150 during joinder of the peel seal material to the inwardly folded flaps by application of heat. Thereafter, webs 146 and 148 are loaded with product, folded and sealed, string zippers are sealed in place, and sliders are inserted in the manner previously described with reference to FIGS. 15 and 16.

Figure 18:
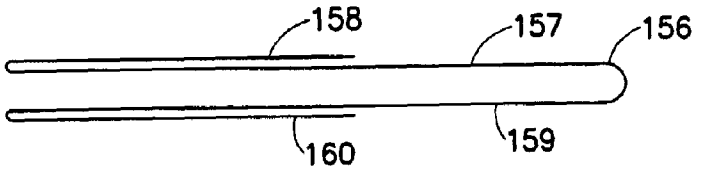
FIGS. 18–22 are drawings showing respective stages in the manufacture of an embodiment of the invention wherein the tamper-evident feature is a header.
Figure 19:
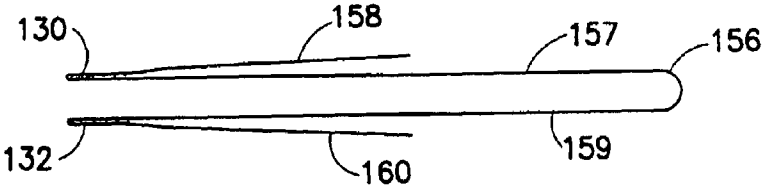
Figure 20:
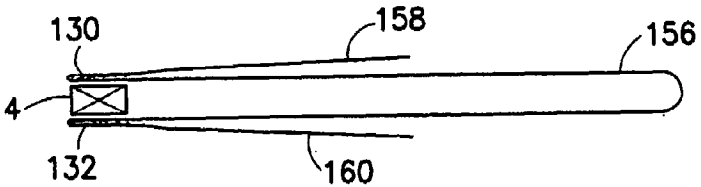
Figure 21:
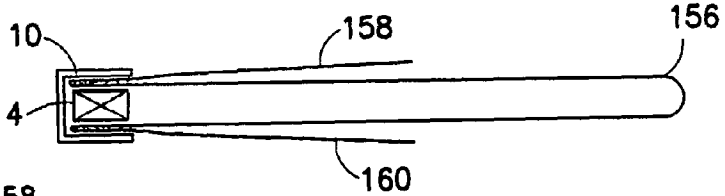

A method for manufacturing an embodiment of the invention wherein the tamper-evident feature comprises a header is partially depicted in FIGS. 18-22. As shown in FIG. 18, a web 156 of film material is folded along three fold lines to form a serpentine profile comprising a pair of inner legs 157 and 159, and a pair of outer legs 158 and 160. The outer leg 158 is connected to the inner leg 157 at the first fold line; the inner leg 157 is connected to the inner leg 159 at the second fold line; and the inner leg 159 is connected to the outer leg 160 at the third fold line. Referring to FIG. 19, the confronting portions of outer leg 158 and inner leg 157 proximal to the first fold line are heat sealed together to form a merged double layer of film 130; likewise the confronting portions of outer leg 160 and inner leg 159 proximal to the third fold line are heat sealed together to form a merged double layer of film 132. In the next step, a string zipper 4 is placed between the respective merged portions 130 and 132, and the latter are respectively joined (e.g., by heat sealing) to opposite sides of the string zipper (i.e., the bases of respective complementary flangeless zipper strips), as seen in FIG. 20. Then a slider is inserted over the string zipper and the film material joined thereto (see FIG. 21). The outer legs 158 and 160 are then folded over the zipper so that the marginal portions of the outer legs are in confronting relationship. The confronting marginal portions of outer legs 158 and 160 are then heat sealed to form a fin seal 162 (see FIG. 22). The resulting header can be open at both ends or, if a hermetic seal is desired, sealed shut at both ends. Thereafter, the assembly shown in FIG. 22 can be cross sealed and cut along a transverse line to sever a finished package from the work in progress. Product can be placed on the web of film material 156 before the web is folded, or the space between the inner legs can be filled before the zipper is applied. Alternatively, after zipper application and slider insertion, product can be loaded when the zipper is open, or the film can be slit to allow the product to be loaded, after which the slit is resealed.

Figure 22:
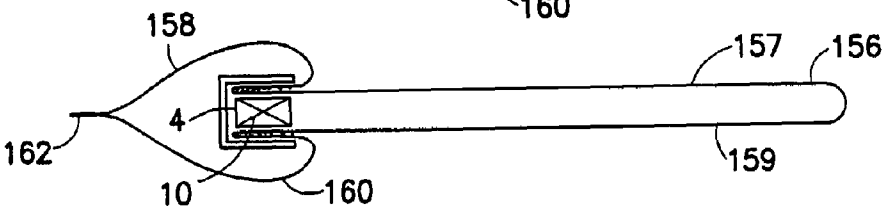

Although not shown in FIG. 22, a respective line of weakened tear resistance can be formed in each outer leg 158, 160, the lines being parallel to the zipper and below the slider, to facilitate removal of the header by a consumer. Each line of weakened tear resistance may comprise a series of spaced perforations (for non-hermetic headers) or a scoreline (for hermetic headers). The lines of weakened tear resistance can be formed in the web 156 before or after the header is formed. Additionally, the header could be provided with a hang hole.

The invention does not require that the slider have a plow or separating finger. The slider-zipper assembly could be designed so that the side walls of a straddling slider cam or push the zipper open, without the aid of a plow or separating finger, when the slider is moved in an opening direction.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "string zipper" means a zipper comprising two interlockable closure strips that have substantially no flange portions.

The invention claimed is:

1. A method of manufacturing a reclosable bag, comprising the following steps:

(a) arranging and sealing film material to form a receptacle having a mouth and an interior volume with a tamper-evident feature that blocks access to said interior volume;

(b) prior to completion of said receptacle with tamper-evident feature, joining opposing portions of said film material, that will form said mouth of said receptacle, to respective backs of first and second flangeless zipper strips;

(c) aligning said first and second flangeless zipper strips with each other; and (d) after steps (b) and (c), mounting a slider onto said aligned first and second flangeless zipper strips with respective portions of said opposing portions of said film material being disposed between respective side walls of said slider and respective backs of said first and second flangeless zipper strips, wherein said arranging step in step (a) comprises folding first and second webs of film material of different width into generally U-shaped structures having marginal edges that are generally aligned, said opposing portions of said film material comprising respective portions of said first and second webs proximal to said marginal edges.

2. A method of manufacturing a reclosable bag, comprising the following steps:

(a) arranging and sealing film material to form a receptacle having a mouth and an interior volume with a tamper-evident feature that blocks access to said interior volume;

(b) prior to completion of said receptacle with tamper-evident feature, joining opposing portions of said film material, that will form said mouth of said receptacle, to respective backs of first and second flangeless zipper strips;

(c) aligning said first and second flangeless zipper strips with each other; and (d) after steps (b) and (c), mounting a slider onto said aligned first and second flangeless zipper strips with respective portions of said opposing portions of said film material being disposed between respective side walls of said slider and respective backs of said first and second flangeless zipper strips, wherein said arranging step in step (a) comprises folding first and second portions of film material to form first and second flaps, and said sealing step in step (a) comprises joining a length of peel seal material to said first and second flaps.

3. A method of manufacturing a reclosable bag, comprising the following steps:

(a) arranging and sealing film material to form a receptacle having a mouth and an interior volume with a tamper-evident feature that blocks access to said interior volume;

(b) prior to completion of said receptacle with tamper-evident feature, joining opposing portions of said film material, that will form said mouth of said receptacle, to respective backs of first and second flangeless zipper strips;

(c) aligning said first and second flangeless zipper strips with each other; and (d) after steps (b) and (c), mounting a slider onto said aligned first and second flangeless zipper strips with respective portions of said opposing portions of said film material being disposed between respective side walls of said slider and respective backs of said first and second flangeless zipper strips, wherein said arranging step in step (a) comprises folding a web of film material so that one marginal edge of said web is proximal to a portion of said web located at a predetermined distance from the other marginal edge of said web, and said sealing step in step (a) comprises joining said one marginal edge to said web portion located at a predetermined distance from said other marginal edge.

4. A method of manufacturing a reclosable bag, comprising the following steps:

(a) arranging and sealing film material to form a receptacle having a mouth and an interior volume with a tamper-evident feature that blocks access to said interior volume;

(b) prior to completion of said receptacle with tamper-evident feature, joining opposing portions of said film material, that will form said mouth of said receptacle, to respective backs of first and second flangeless zipper strips;

(c) aligning said first and second flangeless zipper strips with each other; and (d) after steps (b) and (c), mounting a slider onto said aligned first and second flangeless zipper strips with respective portions of said opposing portions of said film material being disposed between respective side walls of said slider and respective backs of said first and second flangeless zipper strips, wherein said arranging step in step (a) comprises folding a web of film material so that one marginal edge of said web is proximal to a portion of said web located at a predetermined distance from the other marginal edge of said web, and said sealing step in step (a) comprises joining a length of peel seal material to said one marginal edge and said web portion located at a predetermined distance from said other marginal edge.

5. A method of manufacturing a reclosable bag, comprising the following steps:

(a) arranging and sealing film material to form a receptacle having a mouth and an interior volume with a tamper-evident feature that blocks access to said interior volume;

(b) prior to completion of said receptacle with tamper-evident feature, joining opposing portions of said film material, that will form said mouth of said receptacle, to respective backs of first and second flangeless zipper strips;

(c) aligning said first and second flangeless zipper strips with each other; and (d) after steps (b) and (c), mounting a slider onto said aligned first and second flangeless zipper strips with respective portions of said opposing portions of said film material being disposed between respective side walls of said slider and respective backs of said first and second flangeless zipper strips, wherein said arranging step in step (a) comprises folding a web of film material to form a generally U-shaped structure, and placing a panel of film material with one marginal edge of said panel generally aligned with one marginal edge of said folded web and the other marginal edge of said panel being proximal to a portion of said folded web located at a predetermined distance from the other marginal edge of said folded web, and said sealing step in step (a) comprises joining a length of peel seal material to said other marginal edge of said panel and to said portion of said folded web located at a predetermined distance from said other marginal edge of said folded web, said opposing portions of said film material comprising respective portions of said folded web proximal to said marginal edges of said folded web and a portion of said panel proximal to said one marginal edge of said panel.

6. A method of manufacturing a reclosable bag, comprising the following steps:

(a) arranging and sealing film material to form a receptacle having a mouth and an interior volume with a tamper-evident feature that blocks access to said interior volume;

(b) prior to completion of said receptacle with tamper-evident feature, joining opposing portions of said film material, that will form said mouth of said receptacle, to respective backs of first and second flangeless zipper strips;

(c) aligning said first and second flangeless zipper strips with each other; and d) after steps (b) and (c), mounting a slider onto said aligned first and second flangeless zipper strips with respective portions of said opposing portions of said film material being disposed between respective side walls of said slider and respective backs of said first and second flangeless zipper strips, wherein step (a) comprises the following steps:

folding a web of film material along first, second and third fold lines to form a serpentine profile comprising first and second inner legs and first and second outer legs, said first outer leg being connected to said first inner leg at said first fold line, and said second outer leg being connected to said second inner leg at said third fold line, wherein confronting portions of said first inner leg and said first outer leg form said opposing portion joined to said first zipper strip, and confronting portions of said second inner leg and said second outer leg form said opposing portion joined to said second zipper strip;

joining respective portions of said first and second inner legs of said web to form said receptacle;

folding said first outer leg along a fourth fold line;

folding said second outer leg along a fifth fold line; and joining respective opposing portions of said folded first and second outer legs to each other, thus forming a header that covers said zipper strips.

* * * * *